US008057201B2

(12) United States Patent
Shulver et al.

(10) Patent No.: US 8,057,201 B2
(45) Date of Patent: Nov. 15, 2011

(54) VARIABLE DISPLACEMENT VANE PUMP WITH DUAL CONTROL CHAMBERS

(75) Inventors: David R. Shulver, Richmond Hill (CA); Adrian C. Cioc, Ajax (CA)

(73) Assignee: Magna Powertrain Inc., Concord (CA)

( * ) Notice: Subject to any disclaimer, the term of this patent is extended or adjusted under 35 U.S.C. 154(b) by 426 days.

(21) Appl. No.: 12/299,168

(22) PCT Filed: May 4, 2007

(86) PCT No.: PCT/CA2007/000753

§ 371 (c)(1),
(2), (4) Date: Oct. 31, 2008

(87) PCT Pub. No.: WO2007/128105

PCT Pub. Date: Nov. 15, 2007

(65) Prior Publication Data

US 2009/0196780 A1 Aug. 6, 2009

Related U.S. Application Data

(60) Provisional application No. 60/746,422, filed on May 4, 2006.

(51) Int. Cl.
*F04C 2/00* (2006.01)
*F04C 14/18* (2006.01)

(52) U.S. Cl. ..... 418/26; 418/27; 418/30; 417/220

(58) Field of Classification Search ..... 418/26–30, 418/259, 266–268; 417/213, 218–220, 310
See application file for complete search history.

(56) References Cited

U.S. PATENT DOCUMENTS

| | | | | |
|---|---|---|---|---|
| 4,222,718 | A | 9/1980 | Lemke | |
| 4,950,137 | A * | 8/1990 | Fischer et al. | 418/26 |
| 5,236,319 | A | 8/1993 | Fischer et al. | |
| 5,518,380 | A | 5/1996 | Fujii et al. | |
| 5,562,432 | A | 10/1996 | Semba et al. | |
| 5,690,479 | A | 11/1997 | Lehmann et al. | |
| 5,800,131 | A | 9/1998 | Lehmann et al. | |
| 6,619,928 | B2 | 9/2003 | Konishi | |
| 6,722,856 | B2 * | 4/2004 | Schneider | 418/30 |
| 6,763,797 | B1 | 7/2004 | Staley et al. | |
| 7,794,217 | B2 * | 9/2010 | Williamson et al. | 418/26 |

* cited by examiner

*Primary Examiner* — Theresa Trieu
(74) *Attorney, Agent, or Firm* — Harness, Dickey & Pierce, P.L.C.

(57) ABSTRACT

A variable capacity vane pump has a pump control ring which is moveable to alter the volumetric displacement of the pump. The pump ring is moved by at least first and second control chambers, which acts on the pump control ring when pressurized working fluid is supplied to them to move the pump control ring to alter the volumetric capacity of the pump. When pressurized fluid is supplied to only one control chamber, the pump operates at a first equilibrium pressure and when pressurized fluid is also supplied to the second chamber, the pump operates at a second equilibrium pressure. If desired, pressurized fluid can also be supplied only to the second control chamber to operate the pump at a third equilibrium pressure and/or additional control chambers can be provided if required.

17 Claims, 3 Drawing Sheets

VARIABLE DISPLACEMENT VANE PUMP WITH DUAL CONTROL CHAMBERS

CROSS-REFERENCE TO RELATED APPLICATIONS

This application is the national phase under 35 U.S.C. §371 of PCT International Application No. PCT/CA2007/000753, which has an International filing date of May 4, 2007, which designated the United States of America, which PCT application claims the benefit of U.S. Provisional Application No. 60/746,422, filed May 4, 2006. The entire disclosures of each of the above applications are incorporated herein by reference.

FIELD OF THE INVENTION

The present invention relates to variable displacement vane pumps. More specifically, the present invention relates to variable displacement vane pumps in which at least two different equilibrium pressures can be selected between by supplying working fluid to two or more control chambers which act against the control ring.

BACKGROUND OF THE INVENTION

Variable displacement vane pumps are well known and can include a displacement adjusting element, in the form of a pump control ring that can be pivoted or moved to alter the rotor eccentricity of the pump and hence alter the volumetric displacement of the pump. If the pump is supplying a system with a substantially constant orifice size, such as an automobile engine lubrication system, changing the displacement volume of the pump is equivalent to changing the pressure produced by the pump.

Having the ability to alter the volumetric displacement of the pump to maintain an equilibrium pressure is important in environments such as automotive lubrication pumps, wherein the pump will be operated over a range of operating speeds. In such environments, to maintain an equilibrium pressure it is known to employ a feedback supply of the working fluid (e.g. lubricating oil) from the output of the pump to a control chamber where the pressure of the working fluid is used to generate a force, either directly or via a moveable piston, to move the control ring, typically against a biasing force from a return spring, to alter the displacement of the pump.

When the pressure at the output of the pump increases, such as when the operating speed of the pump increases, the increased pressure in the control chamber is applied to the control ring, either directly or via a piston, to overcome the bias of the return spring and to move the control ring to reduce the displacement of the pump, thus reducing the output volume and hence the pressure at the output of the pump.

Conversely, as the pressure at the output of the pump drops, such as when the operating speed of the pump decreases, the decreased pressure supplied to the control chamber allows the bias of the return spring to move the control ring to increase the displacement of the pump, raising the output volume and hence pressure of the pump. In this manner, an equilibrium pressure is obtained at the output of the pump.

The equilibrium pressure is determined by the area of the control ring, or piston, against which the working fluid in the control chamber acts, the pressure of the working fluid supplied to the chamber and the bias force generated by the return spring.

Conventionally, the equilibrium pressure is selected to be a pressure which is acceptable for the expected operating range of the engine and is thus somewhat of a compromise as, for example, the engine may be able to operate acceptably at lower operating speeds with a lower working fluid pressure than is required at higher engine operating speeds. In order to prevent undue wear or other damage to the engine, the engine designers will select an equilibrium pressure for the pump which meets the worst case (high operating speed) conditions. Thus, at lower speeds, the pump will be operating at a higher capacity, supplying a greater pressure of working fluid than required for those speeds, wasting energy pumping the surplus, unnecessary, working fluid.

It is desired to have variable displacement vane pumps which can provide at least two selectable equilibrium pressures in a reasonably compact pump housing.

SUMMARY OF THE INVENTION

It is an object of the present invention to provide a novel variable capacity vane pump which obviates or mitigates at least one disadvantage of the prior art.

According to a first aspect of the present invention, there is provided a variable capacity vane pump having a pump control ring which is moveable to alter the capacity of the pump, the pump being operable at least two selected equilibrium pressures, comprising: a pump housing having a rotor chamber therein; a vane pump rotor rotatably mounted in the rotor chamber; a pump control ring enclosing the vane pump rotor within said rotor chamber, the pump control ring being moveable within the rotor chamber to alter the volumetric displacement of the pump; a first control chamber between the pump housing and the pump control ring, the first control chamber operable to receive pressurized fluid to create a force to move the pump control ring to reduce the volumetric displacement of the pump; a second control chamber operable to receive pressurized fluid to create a force to move the pump control ring to alter the volumetric displacement of the pump; and a biasing spring acting between pump control ring and the pump housing to bias the pump control ring towards a position of maximum volumetric displacement, the biasing spring acting against the force of at least the first control chamber to establish an equilibrium pressure and wherein the supply of pressurized fluid to the second control chamber can be applied or removed to change the equilibrium pressure of the pump.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
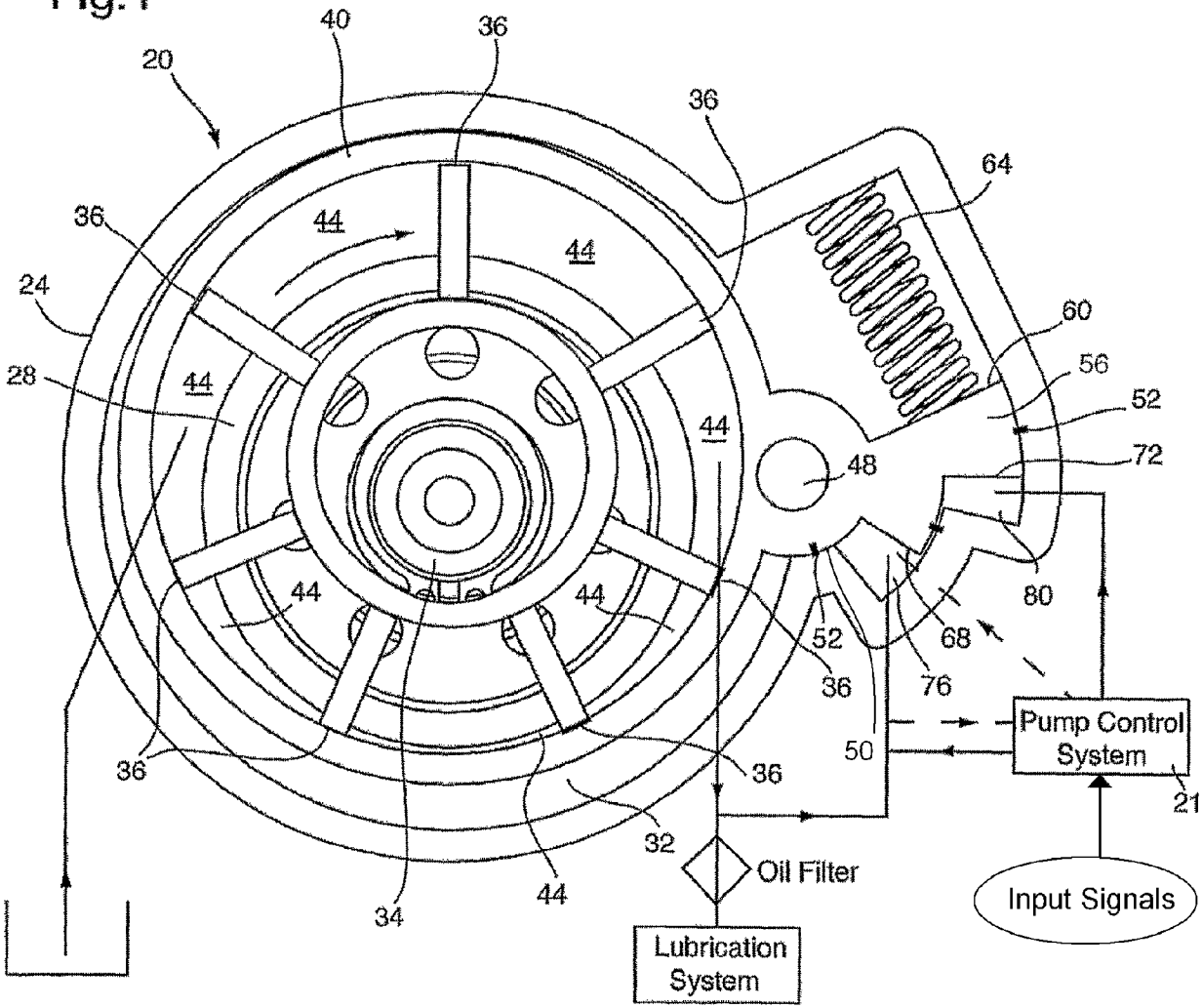
FIG. 1 is a front view of a variable capacity vane pump in accordance with the present invention.

A variable capacity vane pump in accordance with an embodiment of the present invention is indicated generally at 20 in FIG. 1. Pump 20 includes a pump housing 24 which is sealed with a pump cover (not shown).

Pump 20 includes a pump rotor 28 rotatably mounted within a rotor chamber 32 and rotor 28 is turned with a drive shaft 34. A series of slidable pump vanes 36 rotate with rotor 28, the radially outer end of each vane 36 engaging the inner surface of a pump control ring 40 to divide the volume about rotor 28 into a series of pumping chambers 44, defined by the inner surface of pump control ring 40, pump rotor 28 and vanes 36.

In the illustrated embodiment, pump control ring 40 is mounted within housing 24 via a pivot pin 48 mounted in housing 24. It is also contemplated that pump control ring 40 can be pivotally mounted within housing 24 via any other suitable method as will occur to those of skill in the art.

The pivoting of pump control ring 40 allows the center of pump control ring 40 to be moved relative to the center of rotor 28. As the center of pump control ring 40 is located eccentrically with respect to the center of pump rotor 28 and each of the interior of pump control ring 40 and pump rotor 28 are circular in shape, the volume of pumping chambers 44 changes as pumping chambers 44 rotate around rotor chamber 32, with their volume becoming larger at the low pressure side (the left hand side of rotor chamber 32 in FIG. 1) of pump 20 and smaller at the high pressure side (the right hand side of rotor chamber 32 in FIG. 1) of pump 20.

This change in volume of pumping chambers 44 generates the pumping action of pump 20, drawing working fluid from an inlet port (schematically shown) at the low pressure side and pressurizing and delivering the working fluid to an outlet port (schematically shown) at the high pressure side.

By moving pump control ring 40 about pivot surfaces 48 and 50, the amount of eccentricity, relative to pump rotor 28, can be changed to vary the amount by which the volume of pumping chambers 44 changes from the low pressure side of pump 20 to the high pressure side of pump 20, thus changing the volumetric capacity/displacement of pump 20.

Control ring 40 includes a control structure 56 opposite pivot surface 48 from rotor 32. Control structure 56 includes a spring surface 60 and a biasing spring 64 acts between spring surface 60 and pump housing 24 to bias control ring 40 toward the position of maximum eccentricity/maximum displacement for pump 20.

Control structure 56 further includes first and second reaction surfaces, 68 and 72 respectively which, in conjunction with pump housing 24 and resilient seals 52, form first and second control chambers, 76 and 80 respectively.

Each of first and second control chambers 76 and 80 can be supplied with pressurized working fluid from pump 20, either directly from the outlet port of pump 20, or via a pump control system 21 which is being supplied with pressurized working fluid from pump 20. Pump control system 21 is a series of valves that can be operated mechanically or electronically in response to input signals, such as engine speed and oil temperature.

Pressurized working fluid in first control chamber 76 exerts a force on first reaction surface 68 and this force acts against the biasing force of biasing spring 64 to move control ring 40 towards a position wherein the volumetric displacement of pump 20 is reduced.

Similarly, pressurized working fluid in second control chamber 80 exerts a force on second reaction surface 72 and this force acts against the biasing force of biasing spring 64 to move control ring 40 towards a position wherein the volumetric displacement of pump 20 is reduced.

As will be apparent to those of skill on the art, the areas of first reaction surface 68 and second reaction surface 72 can differ, such that the same pressure of working fluid in first control chamber 76 can produce a different force on pump control ring 40 than the pressurized working fluid in second control chamber 80.

Similarly, first and second reaction surfaces 68 and 72 can be located at different radial distances from the point at which control ring 40 pivots, thus applying the forces generated in first and second control chambers 76 and 80 with different mechanical advantages. In the illustrated embodiment, first reaction surface 68 is radially closer to pivot surfaces 48 and 50 than second reaction surface 72 and thus, if reaction surfaces 68 and 72 are the same size and first and second control chambers 76 and 80 are supplied with the same pressure of working fluid, second reaction surface 72 will counter the biasing force of biasing spring 64 to a greater extent than will first reaction surface 68.

As will be apparent to those of skill in the art, if it is desired that each of first and second control chambers 76 and 80 contribute the same amount of movement to control ring 40 for a given pressure, the sizes of first and second reaction surfaces 68 and 72 can be varied from each other to counteract the effects of their different radial distances from the pivot point of control ring 40.

In one embodiment, it is contemplated that one of first control chamber 76 and second control chamber 80 will be supplied with pressurized working fluid, through pump control system 21, from pump 20 while the other of first control chamber 76 and second control chamber 80 will be selectively supplied with pressurized working fluid directly from pump 20. For the purposes of illustration, second control chamber 80 can be selectively supplied with pressurized working fluid. In such a case, pump 20 is operated with the supply of pressurized working fluid to second control chamber 80 removed, pump 20 operates in a substantially conventional manner with a single equilibrium pressure with the force created on control ring 40 by the pressure of the working fluid in first control chamber 76 acting against the biasing force of biasing spring 64.

However, when pressurized working fluid is also supplied to second control chamber 80, via pump control system 21, pump 20 will operate at a second, different, equilibrium operating pressure with the force created on control ring 40 by the pressure of the working fluid in second control chamber 76 adding to the force created by the pressurized working fluid in first control chamber 76 and the sum of these forces act against the biasing force of biasing spring 64.

It is also contemplated that the supply of pressurized working fluid can be selectively supplied to both of first reaction chamber 76 and second reaction chamber 80, as illustrated in broken lines to and from pump control system 21. In such a case, provided that first and second control chambers 76 and 80 produce different forces on control pump ring 40 due to different areas of reaction surfaces 68 and 72 and/or their different radial distances from the pivot point of control ring 40, pump 20 can be operated through pump control system 21 at a selected one of three different equilibrium pressures by selectively providing pressurized working to fluid to: (i) first control chamber 76; (ii) second control chamber 80; and (iii) both of first control chamber 76 and second control chamber 80.

Figure 2:
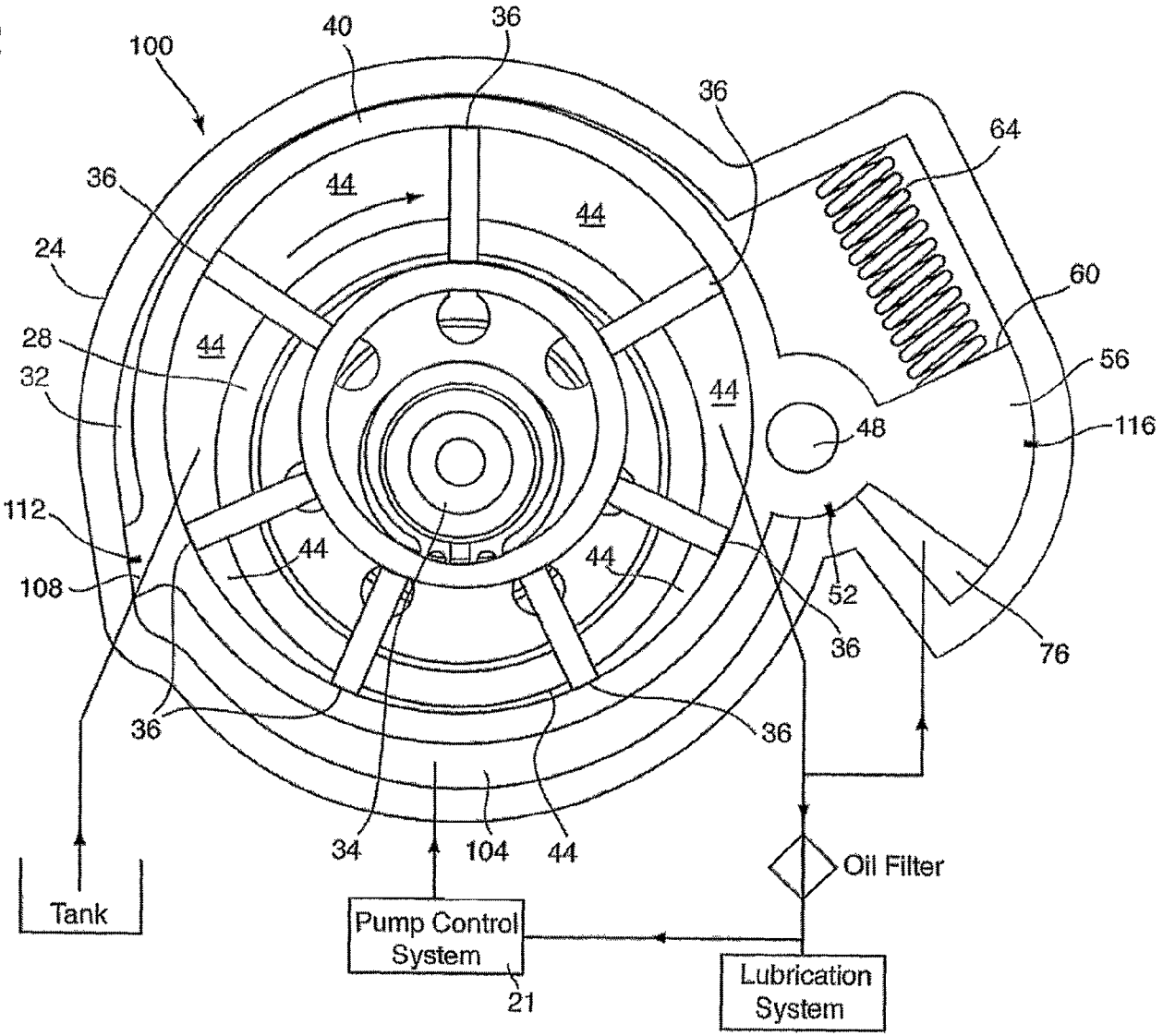
FIG. 2 is a front view of another embodiment of a variable capacity vane pump in accordance with the present invention.

FIG. 2 shows pump 100 which is another embodiment of the present invention wherein similar components to those of pump 20 of FIG. 1 are indicated with like reference numerals. Unlike pump 20, in pump 100 control structure 56 only includes one reaction surface 68 which is part of first control chamber 76. A second control chamber 104 is provided in pump 100, but control chamber 104 is formed between the inner surface of pump housing 24 and the portion of pump control ring 40 between pivot pin 48 and a slider 108. One or both of control chambers 76 and 104 can be selectively supplied, directly or indirectly, with pressurized working fluid from pump 100 to operate pump 100 at any of two, or three, equilibrium operating pressures.

In the embodiment illustrated in FIG. 2, a resilient seal 112 is used to seal one end of control chamber 104 and resilient seal 52 seals the other, as well of one side of control chamber 76, the other side of which is sealed by a resilient seal 116. As will be apparent to those of skill in the art, the use of such seals is not required but such seals can provide a manufacturing cost advantage in that relatively expensive machining steps, which would otherwise be required to ensure adequate sealing of control chambers 76 and 104, can be avoided.

Figure 3:
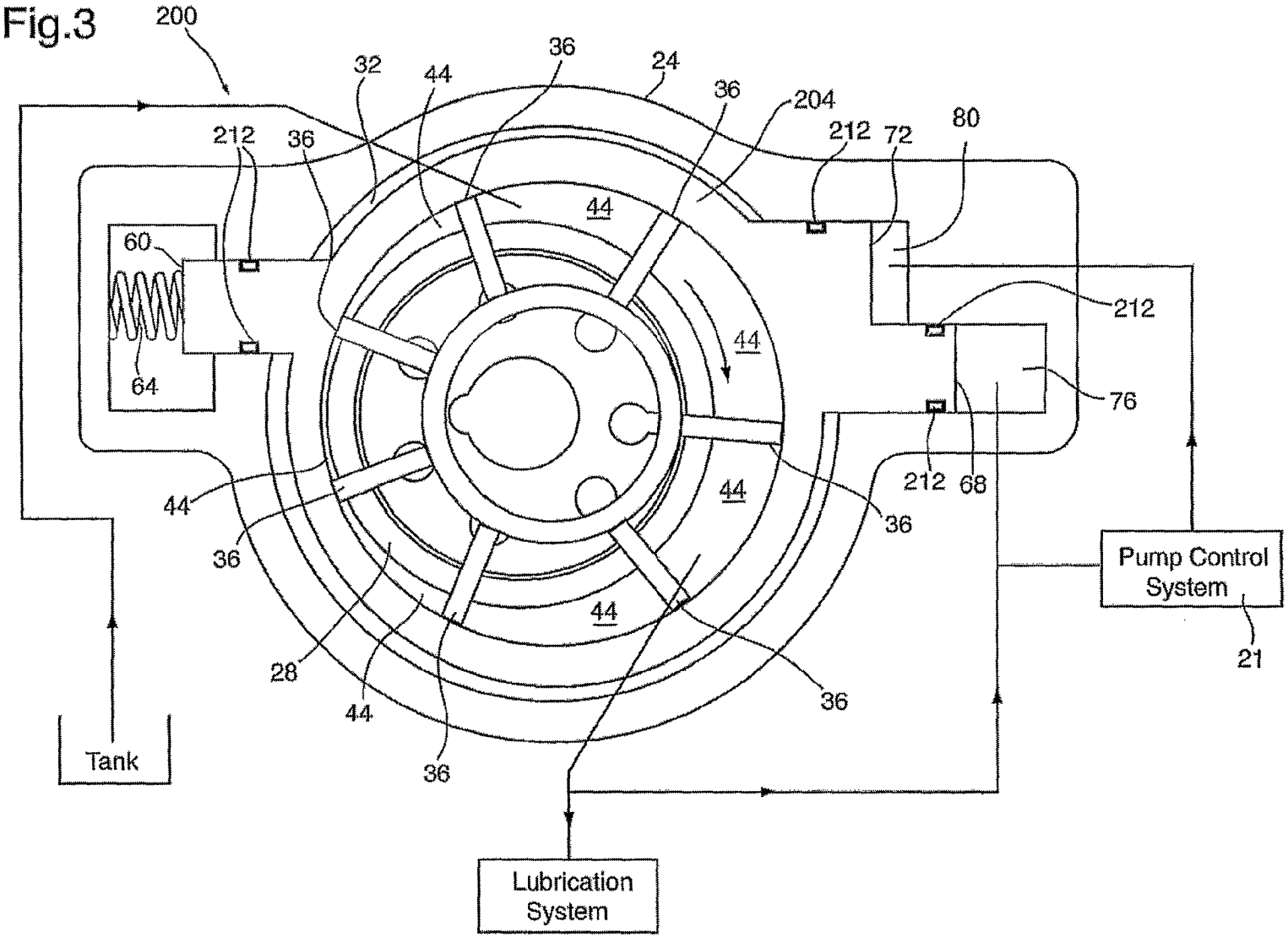
FIG. 3 is a front view of another embodiment of a variable capacity vane pump in accordance with the present invention.

FIG. 3 shows a pump 200 which is another embodiment of the present invention wherein similar components to those of pump 20 of FIG. 1 are indicated with like reference numerals. Unlike pump 20, pump 200 employs a sliding control ring 204 instead of a pivoting control ring. As shown, control ring 204 includes reaction surface 60 and a biasing spring 64 acts between pump housing 24 and reaction surface 60 to bias control ring 204 to the maximum eccentricity/maximum displacement position. Control ring 204 further includes two reaction surfaces 68 and 72 which serve as a moveable portion of control chambers 76 and 80 respectively.

As illustrated, control ring 204 is sealed with resilient seals 212. As mentioned above, the use of such seals is not required but such seals can provide a manufacturing cost advantage in that relatively expensive machining steps, which would otherwise be required to ensure adequate sealing of control ring 204 with respect to control chambers 76 and 80, etc. can be avoided.

In operation, one or both of control chambers 76 and 80 can be selectively supplied, directly or indirectly, with pressurized working fluid from pump 200 to operate pump 200 at any of two, or three, equilibrium operating pressures. The method of selectively supplying pressurized working fluid from pump 200 to control chambers 76 and 80 is not particularly limited and can comprise a mechanical or solenoid operated valve etc. If it is desired to operate at pump 200 at a selectable one of two equilibrium pressures, it is contemplated that one of control chambers 76 or 80 can be always connected, directly or indirectly, to the outlet of pump 200 while the other of control chambers 76 and 80 will selectively be supplied with pressurized working fluid. When the other of control chambers 76 and 80 is selectively supplied with pressurized working fluid, the force created on the respective reaction surface in that control chamber adds to the force created on the reaction surface of the other control chamber to further slide control ring 204 towards biasing spring 64, further reducing the displacement of pump 200.

As will be apparent to those of skill in the art, the sizes and locations of reaction surfaces 60, 68 and 72 and control chambers 76 and 80 can be altered, as required, to meet a particular requirement for pump 200. For example, control chambers 76 and/or 80 can be repositioned to better counter and/or reduce reaction forces exerted on pump control ring 204 during operation of pump 200. Further, additional resilient seals can be employed, as necessary, to provide additional sealing.

The above-described embodiments of the invention are intended to be examples of the present invention and alterations and modifications may be effected thereto, by those of skill in the art, without departing from the scope of the invention which is defined solely by the claims appended hereto.

What is claimed is:

1. A variable capacity vane pump comprising:

a pump housing having a rotor chamber therein;

a vane pump rotor rotatably mounted in the rotor chamber and having a series of vanes;

a pump control ring enclosing the vane pump rotor within said rotor chamber and engaging said vanes, the pump control ring being moveable within the rotor chamber to alter the volumetric displacement of the pump;

a first control chamber between the pump housing and the pump control ring, the first control chamber operable to receive pressurized fluid to create a force to move the pump control ring to reduce the volumetric displacement of the pump;

a second control chamber operable to receive pressurized fluid to create a force to move the pump control ring to alter the volumetric displacement of the pump; and a biasing spring acting between the pump control ring and the pump housing to bias the pump control ring towards a position of maximum volumetric displacement, the biasing spring acting against the force of at least the first control chamber to establish an equilibrium pressure, pressurized fluid being supplied to the second control chamber to change the equilibrium pressure of the pump, wherein the pump control ring pivots about a pivot pin to alter the volumetric displacement of the pump, the pump control ring including a control structure located opposite the pivot point from the rotor, the forces created in the first and second control chambers acting against the control structure.

2. The variable capacity pump of claim 1 further comprising a pump control system in fluid communication with at least one of the first control chamber and the second control chamber whereby pressurized fluid is supplied to the first control chamber when the pump is operating and pressurized fluid is supplied to a second control chamber only in response to an input signal.

3. The variable capacity pump of claim 2 wherein the second control chamber produces a force on the pump control ring which opposes the force the biasing spring applies to the pump control ring.

4. The variable capacity pump of claim 2 wherein the second control chamber produces a force on the pump control ring which adds to the force the biasing spring applies to the pump control ring.

5. The variable capacity pump of claim 1 wherein the first control chamber is in fluid communication with an outlet of the pump and receives the pressurized fluid therefrom.

6. The variable capacity pump of claim 1 wherein the second chamber is formed between the pump housing and the pump control ring.

7. The variable capacity pump of claim 6 wherein the pump control ring further includes a resilient seal acting between the pump control ring and the pump housing, being spaced apart from the pivot pin, and a resilient seal acting between the pump control ring and the pump housing adjacent the pivot pin to define the second control chamber.

8. The variable capacity pump of claim 1 wherein a supply of pressurized fluid is selectively applied to either or both of the first and second control chambers to select from three equilibrium pressures for the pump.

9. The variable capacity pump of claim 1, wherein the control structure includes an arm outwardly protruding from an outer surface of the control ring, the arm including a reaction surface on which pressurized fluid from one of the first and second control chambers acts.

10. A variable capacity vane pump comprising:

a pump housing having a rotor chamber therein;

a vane pump rotor rotatably mounted in the rotor chamber and having a series of vanes;

a pump control ring enclosing the vane pump rotor within said rotor chamber and engaging said vanes, whereby as the vane pump rotor rotates fluid is drawn into the rotor chamber and then discharged from the rotor chamber as pressurized fluid, the pump control ring being moveable within the rotor chamber to alter the volumetric displacement of the pump;

a first control chamber between the pump housing and the pump control ring, the first control chamber operable to receive a portion of said pressurized fluid to create a force to move the pump control ring to reduce the volumetric displacement of the pump;

a second control chamber operable to receive a portion of said pressurized fluid to create a force to move the pump control ring to alter the volumetric displacement of the pump;

a biasing spring acting between the pump control ring and the pump housing to bias the pump control ring towards a position of maximum volumetric displacement, and a pump control system in fluid communication with said rotor chamber and the first control chamber and the second control chamber whereby pressurized fluid is selectively supplied to the first control chamber and the second control chamber in response to an input signal to control volumetric output of said pump, wherein the pump control ring comprises a control structure including first and second protrusions outwardly extending from an outer surface of the pump control ring, the first protrusion including a first reaction surface being acted on by the pressurized fluid in the first control chamber, and the second protrusion including a second reaction surface being acted on by the pressurized fluid in the second control chamber.

11. The variable capacity pump of claim 10, wherein said input signal is based on engine speed and fluid temperature.

12. The variable capacity pump of claim 11, wherein said pump control system selectively opens fluid communication with said first control chamber to establish a first equilibrium volumetric capacity and opens fluid communication with said second control chamber to establish a second equilibrium volumetric capacity.

13. The variable capacity pump of claim 12, wherein said pump control system closes fluid communication with said first control chamber and opens fluid communication with said second control chamber to establish a third equilibrium volumetric capacity.

14. The variable capacity pump of claim 10 wherein the first and second protrusions are positioned adjacent to one another.

15. The variable capacity pump of claim 10, further including first and second resilient seals acting between the pump control ring and the housing to define one of the first and second chambers, wherein the housing includes a wall having surfaces intersecting one another to define an inflection point, the inflection point being positioned between the first and second resilient seals.

16. The variable capacity pump of claim 15 wherein the surfaces of the wall intersect at substantially ninety degrees.

17. The variable capacity pump of claim 10, wherein the control ring is pivotable about an axis, one of the first and second reaction surfaces being positioned a further radial distance from the axis than the other reaction surface.

* * * * *